US010370842B2

(12) United States Patent
Wesney et al.

(10) Patent No.: US 10,370,842 B2
(45) Date of Patent: Aug. 6, 2019

(54) SLOPE AND SKEW HANGER

(71) Applicants: Joe L Wesney, Dublin, OH (US); Kashane Vilasineekul, Powell, OH (US)

(72) Inventors: Joe L Wesney, Dublin, OH (US); Kashane Vilasineekul, Powell, OH (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 15/388,712

(22) Filed: Dec. 22, 2016

(65) Prior Publication Data

US 2017/0175381 A1 Jun. 22, 2017

Related U.S. Application Data

(60) Provisional application No. 62/271,153, filed on Dec. 22, 2015.

(51) Int. Cl.

| | |
|---|---|
| ***E04B 1/38*** | (2006.01) |
| ***E04B 1/41*** | (2006.01) |
| ***E04B 1/26*** | (2006.01) |

(52) U.S. Cl.

CPC ..... *E04B 1/40* (2013.01); *E04B 1/2612* (2013.01); *E04B 2001/2644* (2013.01); *E04B 2001/405* (2013.01)

(58) Field of Classification Search

CPC ..... E04B 1/40; E04B 2001/405
USPC ..... 52/702
See application file for complete search history.

(56) References Cited

U.S. PATENT DOCUMENTS

| | | | |
|---|---|---|---|
| 508,280 | A | 11/1893 | Cavallaro |
| 2,911,690 | A | 11/1959 | Sanford |
| 2,990,590 | A | 7/1961 | Graveley |
| 3,036,347 | A | 5/1962 | Findleton |
| 3,333,875 | A | 8/1967 | Tracy |
| 3,596,941 | A | 8/1971 | Tracy |

(Continued)

FOREIGN PATENT DOCUMENTS

| | | |
|---|---|---|
| DE | 10036754 | 6/2002 |
| GB | 185694 | 9/1922 |

(Continued)

OTHER PUBLICATIONS

Catalog, 1991, pp. 33, 35, 37, 40, and 41 (5 pages), 06060/SIM BuyLine 5162, Simpson Strong-Tie Company, Inc., Pleasanton, CA.

(Continued)

*Primary Examiner* — Joshua J Michener
*Assistant Examiner* — James Buckle, Jr.
(74) *Attorney, Agent, or Firm* — James R. Cypher; Charles R. Cypher

(57) ABSTRACT

A connector is provided to attach a supported member to a supporting member, with the supported member being in sloped and skewed relation to the supporting member. The hanger has left and right back members and left and right side support members attached to the left and right back members respectively. A seat member attaches to both the left and right back members along aligned left and right seat bend lines. A pair of seat side members can extend from the seat member. A pair of left and right jutting tabs extend from the left and right back members respectively.

14 Claims, 11 Drawing Sheets

(56) References Cited

U.S. PATENT DOCUMENTS

| | | | | | |
|---|---|---|---|---|---|
| 3,601,428 | A * | 8/1971 | Gilb | E04B 1/2608 | 248/217.3 |
| 4,144,683 | A | 3/1979 | Dean | | |
| 4,230,416 | A * | 10/1980 | Gilb | E04B 1/2612 | 248/300 |
| 4,261,155 | A * | 4/1981 | Gilb | E04B 1/2612 | 248/282.1 |
| 4,291,996 | A * | 9/1981 | Gilb | E04B 1/2612 | 403/14 |
| 4,330,971 | A * | 5/1982 | Auberger | E06B 1/6092 | 403/232.1 |
| 4,423,977 | A * | 1/1984 | Gilb | E04B 1/2608 | 403/232.1 |
| 4,480,941 | A * | 11/1984 | Gilb | E04B 1/2612 | 248/216.1 |
| 4,560,301 | A * | 12/1985 | Gilb | B21D 53/38 | 403/232.1 |
| 4,841,690 | A * | 6/1989 | Commins | E04B 1/2612 | 52/105 |
| 5,004,369 | A | 4/1991 | Young | | |
| 5,054,755 | A * | 10/1991 | Hawkes | B25B 5/06 | 269/239 |
| 5,071,280 | A * | 12/1991 | Turner | E04B 1/2612 | 403/232.1 |
| 5,111,632 | A * | 5/1992 | Turner | E04B 1/2612 | 403/232.1 |
| 5,190,268 | A | 3/1993 | Espinueva | | |
| 5,217,317 | A * | 6/1993 | Young | E04B 1/2612 | 403/14 |
| 5,240,342 | A * | 8/1993 | Kresa, Jr. | E04B 1/2612 | 248/300 |
| 5,457,928 | A * | 10/1995 | Sahnazarian | E04B 1/2612 | 403/232.1 |
| 5,564,248 | A * | 10/1996 | Callies | E04B 1/2612 | 403/232.1 |
| 5,603,580 | A * | 2/1997 | Leek | E04B 1/2612 | 403/168 |
| 5,778,625 | A * | 7/1998 | Druffel | F21S 8/02 | 174/480 |
| 5,797,694 | A * | 8/1998 | Breivik | E04B 1/2608 | 403/231 |
| 6,079,176 | A * | 6/2000 | Westra | E04G 9/10 | 249/15 |
| 6,123,745 | A * | 9/2000 | Hess, III | E02D 27/016 | 249/30 |
| 6,230,466 | B1 | 5/2001 | Pryor | | |
| 7,334,372 | B2 * | 2/2008 | Evans | E04B 1/2612 | 52/289 |
| 7,343,712 | B2 * | 3/2008 | Shelton | E04G 23/0218 | 52/126.1 |
| 7,503,148 | B2 * | 3/2009 | Lin | E04B 1/2608 | 248/300 |
| 7,913,472 | B2 | 3/2011 | Troth et al. | | |
| 7,971,409 | B2 * | 7/2011 | Bak | E04B 1/2612 | 29/897.34 |
| 8,250,827 | B2 * | 8/2012 | Lin | E04B 1/2612 | 52/289 |
| 8,387,333 | B2 * | 3/2013 | Brekke | E04B 1/2612 | 403/232.1 |
| 8,443,569 | B2 | 5/2013 | Sias | | |
| 8,615,942 | B2 | 12/2013 | Lafreniere | | |
| 8,720,155 | B1 | 5/2014 | Robell | | |
| 2004/0244328 | A1 * | 12/2004 | Bak | E04B 1/2612 | 52/712 |
| 2006/0191233 | A1 * | 8/2006 | Tamlyn | E04B 1/2612 | 52/702 |
| 2008/0101855 | A1 * | 5/2008 | Lin | E04B 1/2612 | 403/232.1 |
| 2008/0163568 | A1 * | 7/2008 | Shelton | E04G 23/0218 | 52/126.1 |
| 2009/0113839 | A1 * | 5/2009 | Carr | E04B 1/2612 | 52/712 |
| 2012/0222382 | A1 * | 9/2012 | Brekke | E04B 1/2612 | 52/702 |
| 2012/0297724 | A1 * | 11/2012 | Pope | E04B 1/2604 | 52/702 |

FOREIGN PATENT DOCUMENTS

| | | |
|---|---|---|
| GB | 2163788 | 3/1986 |
| GB | 2399109 | 1/2005 |
| WO | WO 2001/006068 | 1/2001 |
| WO | WO 2008/007325 | 1/2008 |

OTHER PUBLICATIONS

"Solid Sawn Joist Hangers," Catalog, 2013, cover and p. 83 (2 pages), Wood Construction Connectors 2013-2014 C-2013, Simpson Strong-Tie Company, Inc., Pleasanton, CA.

"Plated Truss Connectors," Catalog, 2011, cover and pp. 137-138 (3 pages), Wood Construction Connectors 2011-2012 C-2011, Simpson Strong-Tie Company, Inc., Pleasanton, CA.

"Statische Berechnungen Teil 2-BOZETT-Balken-Z-Profile," Catalog, May 1998, 16 pages, BS 292, Bulldog Simpson GMBH, Germany.

"Skewed Truss Hanger" "Tite Angle Skewed Hanger," Catalog, 1992, p. 8 (1 page), Southeastern Metals, Jacksonville, FL.

"Solid Sawn Joist Hangers—LRUZ Rafter Hanger," Catalog, Dec. 2014, pp. 92-93 (2 pages), C-C-2015, Simpson Strong-Tie Company, Inc., Pleasanton, CA.

* cited by examiner

SLOPE AND SKEW HANGER

BACKGROUND

This invention relates to a connector for joining structural members and the connection made therewith. In particular, the present invention has particular application as a simple, inexpensive hanger for strengthening a connection between a ridge or valley member and a sloping and skewed rafter member or joist.

U.S. Pat. No. 4,230,416, granted in 1980 to Tyrell T. Gilb, teaches a simple hanger for skewed installations. The hanger was not designed for sloped installations, and left and right skew versions of the part had to be made.

U.S. Pat. No. 4,423,977, granted in 1984 to Tyrell T. Gilb, which is hereby incorporated by reference, provides a good background of the history of patented slope and skew connections. In the background section of U.S. Pat. No. 4,423,977, the inventor spent much time discussing the problems with early solutions that required the notching of the sloped rafter or joist members. A typical hanger has a seat member to support the joist and the seat member is typically disposed orthogonally with respect to the attachment face of the support member; that is to say, typically the seat of the hanger juts out horizontally. This is ideal for most floor and wall connections where the joists themselves are disposed horizontally and the bottom of the joist rests on the seat of the hanger. However, in sloped connections the bottom of the sloped rafter or jack member will typically be disposed at a slope that is not horizontal. For some joists or rafters a typical hanger with a horizontal seat can be an acceptable choice if the joist or rafter can be notched to create a small horizontal face that rests on the seat of the hanger. However, notching the rafter takes time, and some rafters, particularly I-joists, cannot or should only be notched in very limited situations. Thus, inventors have sought to create hangers for sloped connections where the seat of the hanger is disposed at a sloped angle to interface with the base of the rafter or joist. This way the joist or rafter does not have to be notched if the user wants to have interfacing contact between a seat on the hanger and the bottom surface of the joist.

U.S. Pat. No. 4,423,977 teaches a simple slope and skew hanger that is made from cutting a blank of sheet metal and cold-forming bends in the sheet metal. Some of the bends can be modified on site during final installation by what is known in the art as field bending. Gilb's single-piece, sheet metal hanger accommodates attaching a rafter or a joist member disposed at varying slopes and skew angles with respect to the ridge member. The Gilb hanger of U.S. Pat. No. 4,423,977 could accommodate joists or rafters at varying slopes because the seat member was not directly connected to the side members or jutting tabs that interfaced with the joist and steadied the joist. The seat member was free to bend to interface with the bottom of the joist at a variety of angles.

U.S. Pat. No. 5,457,928, granted to George Sahnazarian in 1995, teaches a slope and skew hanger similar to the Gilb hanger of U.S. Pat. No. 4,423,977. Sahnazarian claimed adding ribs to the members that attached the hanger to the ridge member. U.S. Pat. No. 5,797,694, granted to Arne Norris Breivik in 1998, also teaches a slope and skew hanger similar to the Gilb hanger of U.S. Pat. No. 4,423,977. Breivik claimed shaping the members that attached the hanger to the ridge member in a particular manner.

U.S. Pat. No. 7,503,148, granted to Jin-Jie Lin in 2009, teaches a simple hanger that can accommodate multiple members at various skew angles. The Lin hanger can be modified in the field to the skew angles of the joist or joists, because, in a manner similar to the Gilb hanger, the side members or jutting tabs were not directly attached to the seat member.

The present invention is a connector and connection made with that connector that like the prior art makes a sloped and skewed connection while providing additional features not found in the prior art.

SUMMARY OF THE INVENTION

The present invention provides a connector that is easy to install when the supported member is already attached to and being held by the supporting member. Such an installation is called a retrofit installation. The back members of the present connector are spaced apart from each other a sufficient distance to accept the supported member between them with little or no contact between the left and right sides of the supported member and the back members, and with no contact between the back members and the end face of the supported member. In this way, the connector of the present invention can be inserted into position to engage the supported member and the supporting member to strengthen the connection. The back members of the connector are held in position by a generally planar seat member that is attached to the left and right back members at aligned left and right seat bend lines. This attachment of a generally planar seat member through left and right aligned seat bend lines to separated left and right back members results in a strong connector that can use fewer fasteners than similar connections.

The present invention provides a connector that can support a held member with respect to a holding member with the held member being skewed (right or left) and sloped (up or down) at the same time. The present invention also provides a connector that can hold a supported member that can hang below the supporting member. The connector interfaces with the bottom face of the supported member, and extends upwardly along the attachment face of the supporting member where fasteners attach the connector to the supporting member.

Another advantage of one embodiment of the present invention is that the hanger is field bent along only three bend lines to provide slope and/or skew adjustments.

DETAILED DESCRIPTION OF THE INVENTION

Figure 1:
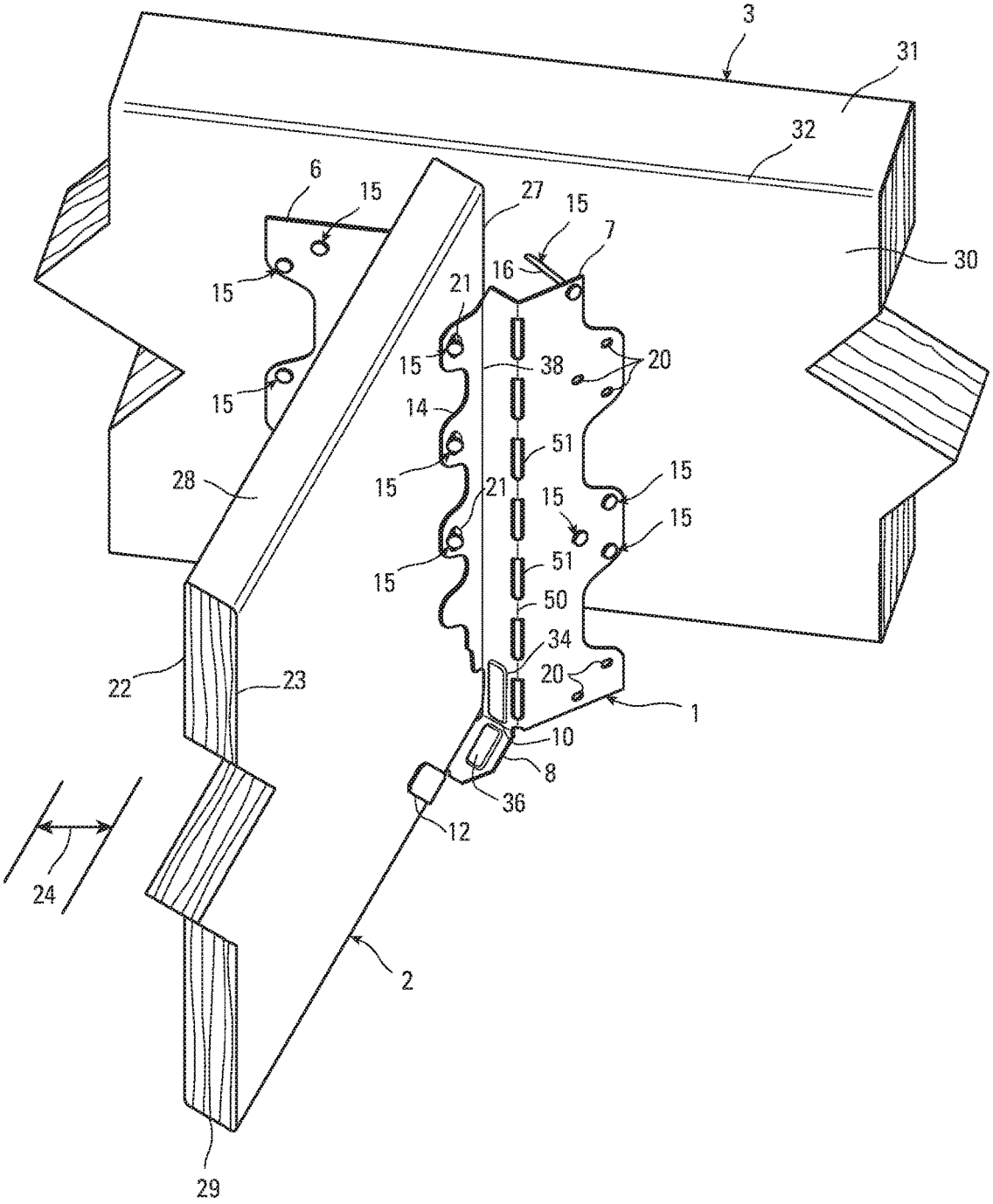
FIG. 1 is a perspective view of the connection of the present invention.
Figure 4:
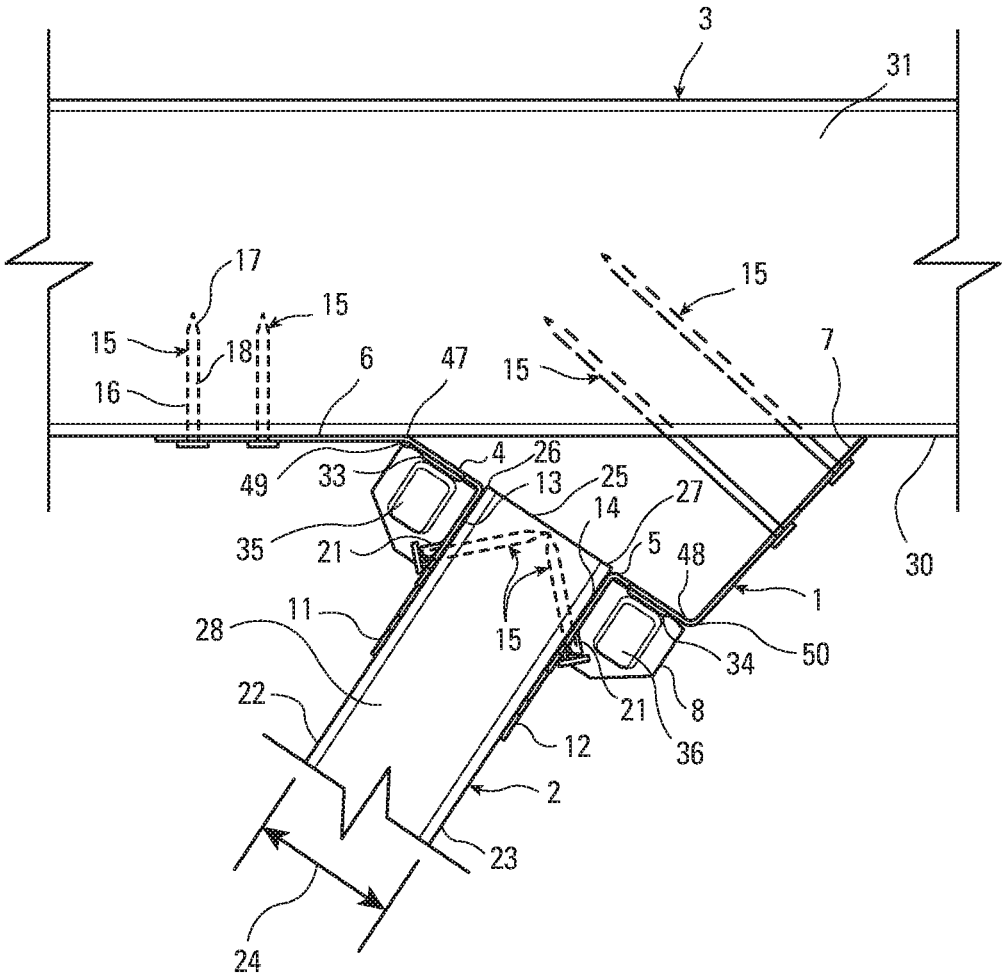
FIG. 4 is a top view of the connection of FIG. 1. Fasteners embedded in the supported and supporting members are shown in dotted lines.

Referring to FIGS. 1 and 4 of the drawings, the connector or hanger 1 of the present invention is designed to attach a supported member 2 to a supporting member 3, with the supported member 2 being in sloped and skewed relation to the supporting member 3. The hanger 1 has left and right back members 4 and 5. Left and right side support members 6 and 7 are attached to the left and right back members 4 and 5 respectively. A seat member 8 attaches to both the left and right back members 4 and 5 along aligned left and right seat bend lines 9 and 10. The preferred embodiment has a pair of left and right seat side members 11 and 12 extending upwardly from the seat member 8. The preferred embodiment is also formed with a pair of left and right jutting tabs 13 and 14 extending from the left and right back members 4 and 5 respectively on opposed sides from the left and right side support members 6 and 7. Preferably, fasteners 15 are used to attach the connector 1 to the supported and supporting members 2 and 3. As shown in FIG. 4, the fasteners 15 driven through the jutting tabs 13 and 14 can be driven at an angle such that they first enter the supported member 2 and then the supporting member 3 to strengthen the connection even further. The fastener 15 is preferably formed with a shank 16 having an end portion 17 and a middle portion 18. The end portion 17 of the shank 16 of the fastener 15 is embedded in the supporting member 3 and the middle portion 18 of the shank 16 of the fastener 15 is embedded in the supported member 2. The fasteners 15 shown are nails, but screws and other similar fasteners may be used. The connector 1 is preferably formed with a combination of round fastener openings 19, restricted slot fastener openings 20 and fastener guides 21 to aid the user in positioning and driving the fasteners 15 that make the attachment.

Figure 5:
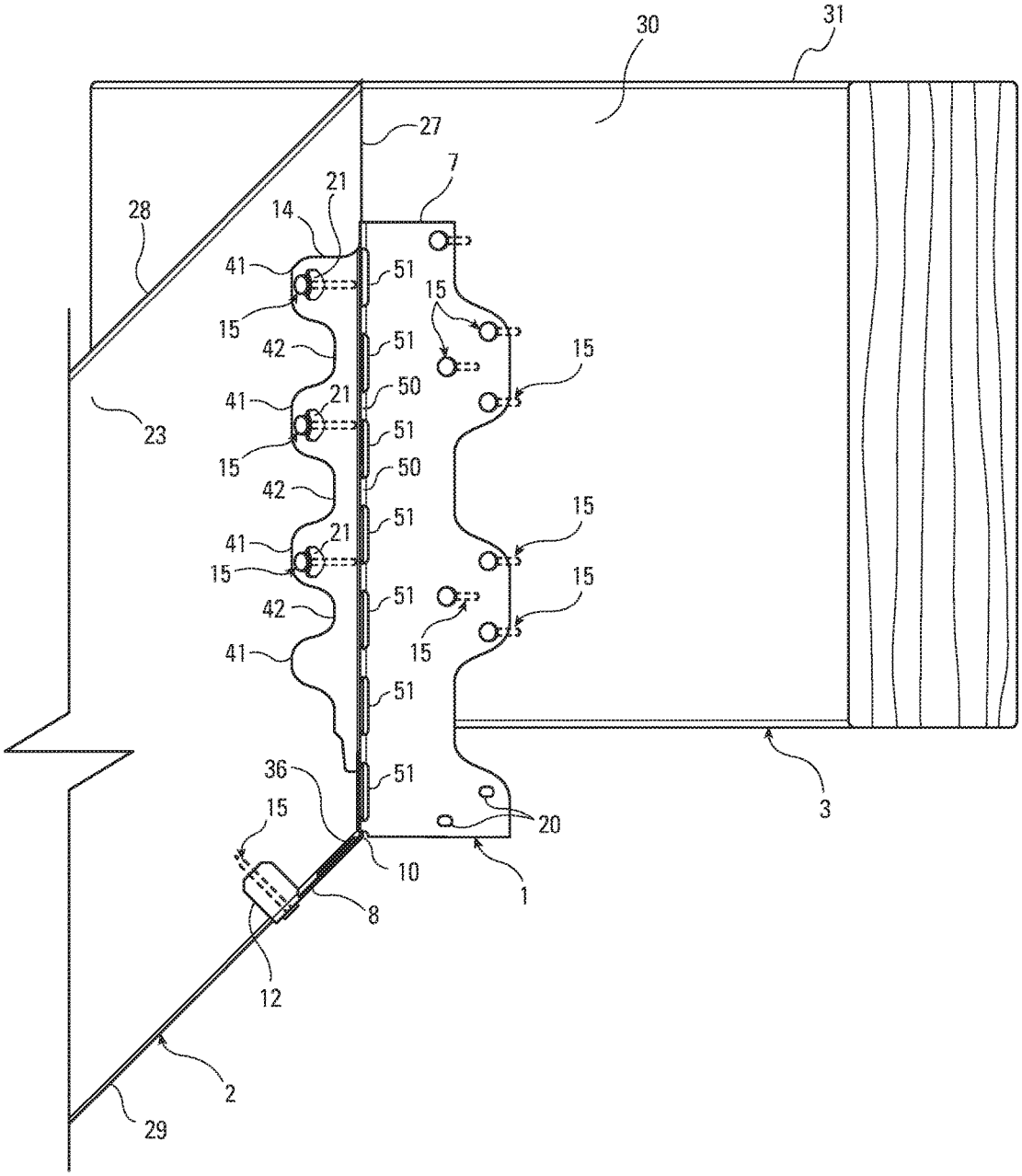
FIG. 5 is a side view of the connection of FIG. 1. Fasteners embedded in the supported and supporting members are shown in dotted lines.
Figure 6:
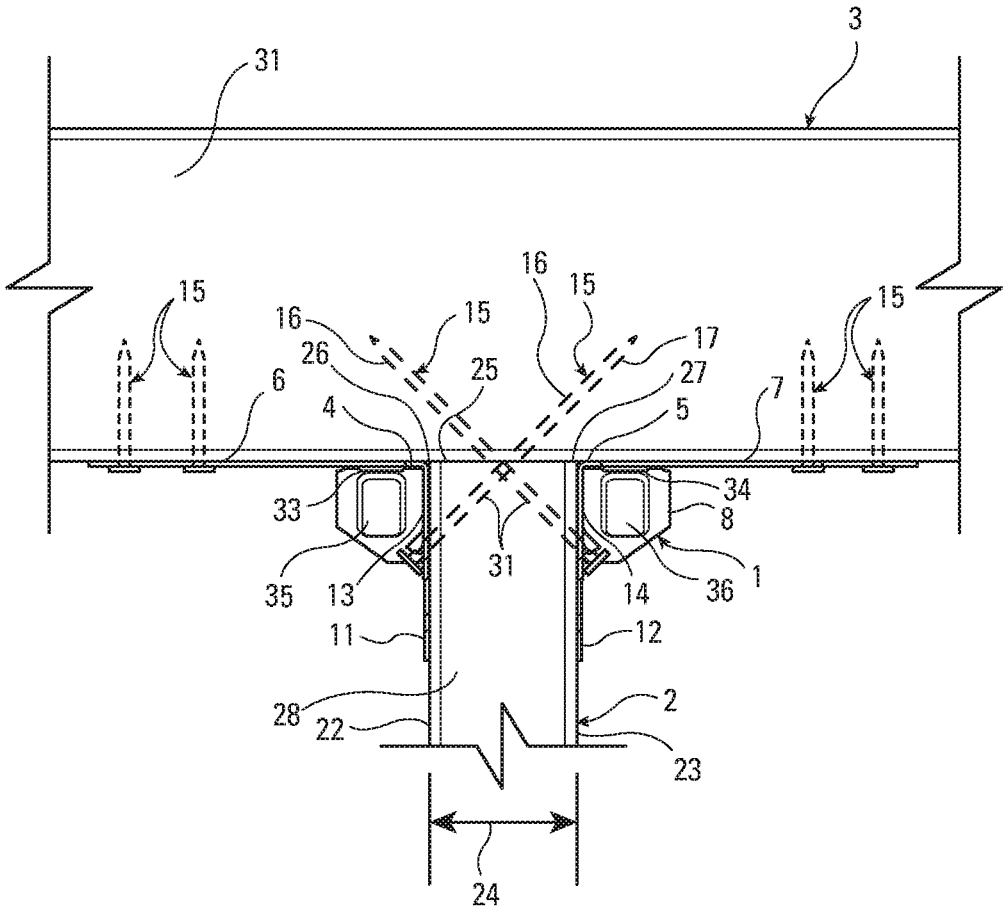
FIG. 6 is a top view of an alternate connection of the present invention.

As shown in FIGS. 1 and 4, the supported member 2 is formed with left and right sides 22 and 23 that are generally parallel to each other and are spaced apart a first selected distance 24. The supported member 2 is also formed with an end face 25 that meets with the left and right sides 22 and 23 of the supported member 2 at left and right side edges 26 and 27 of the end face 25. As shown in FIG. 1, the supported member 2 can be formed with a top face 28 and a bottom face 29 that meet with the left and right sides 22 and 23 and the end face 25. As shown in FIG. 5, the top and bottom faces 28 and 29 are generally parallel with each other and can be at a sloped angle to the generally vertically disposed end face 25. A sloping angle is an angle other than 90 degrees. The supporting member 3 has an attachment face 30 and a top face 31 that meets the attachment face 30 at a top edge 32 of the attachment face 30. As shown in FIG. 5, the attachment face 30 is generally vertically disposed and the top face 31 of the supporting member 3 is generally horizontally disposed, although the top face 31 could also be at a sloped orientation.

Figure 3:
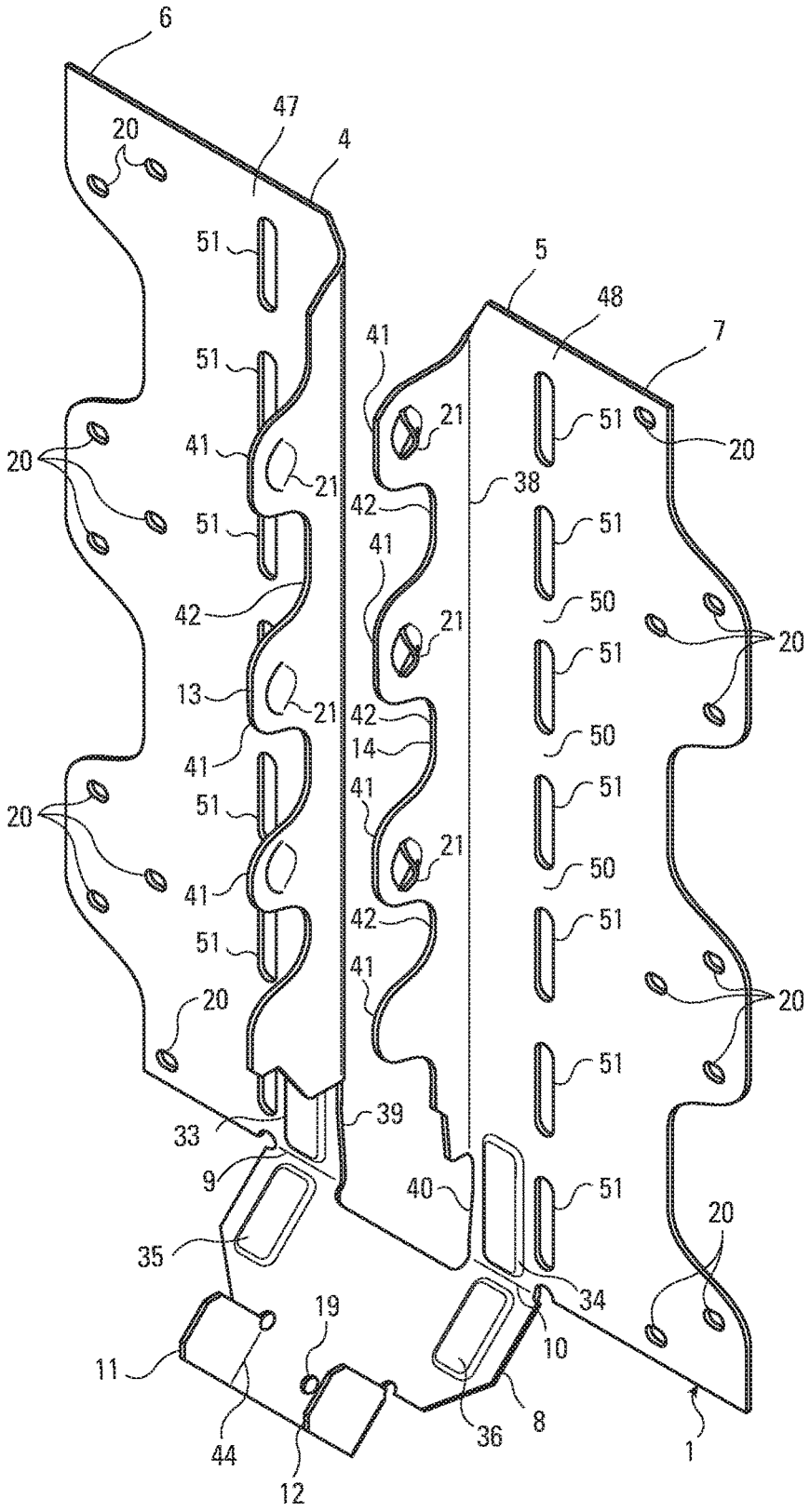
FIG. 3 is a perspective view of the connector of the present invention.
Figure 7:
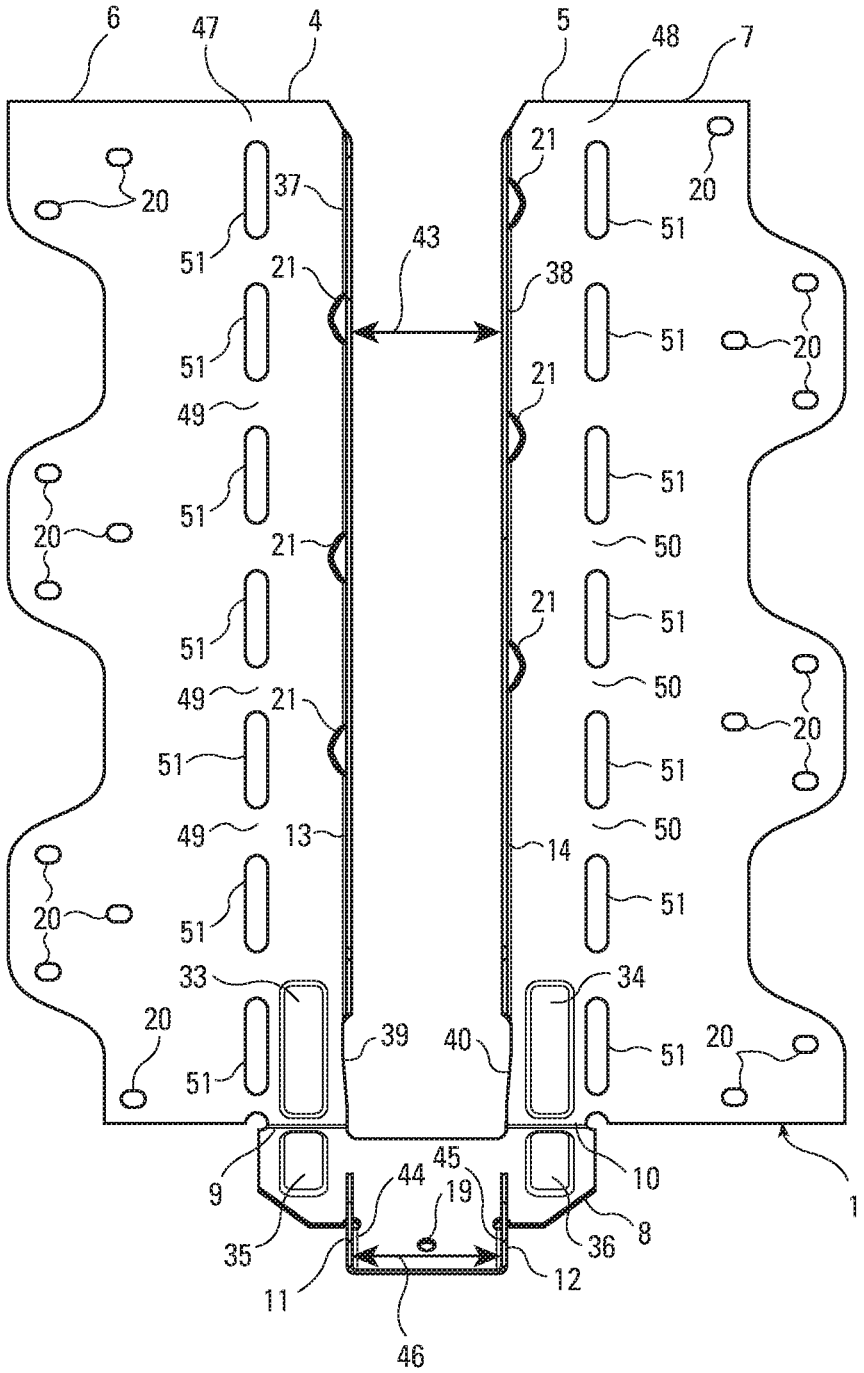
FIG. 7 is a front view of the connector of the present invention.
Figure 8:
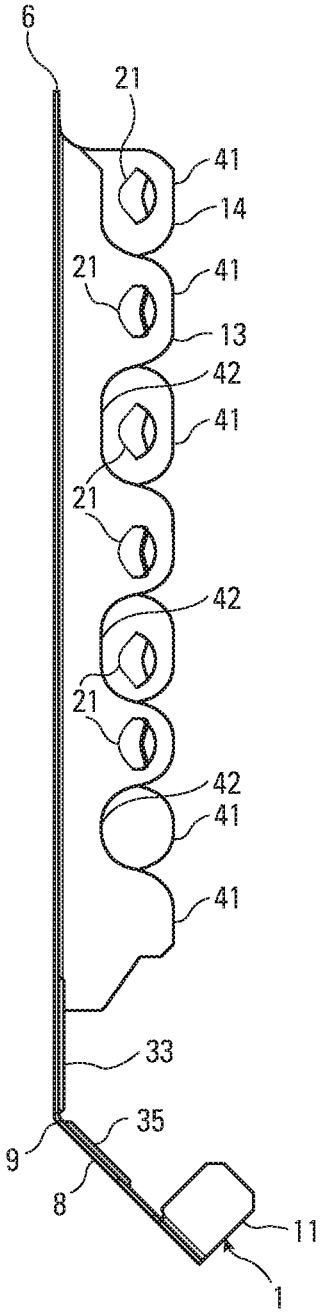
FIG. 8 is right side view of the connector of the present invention.
Figure 9:
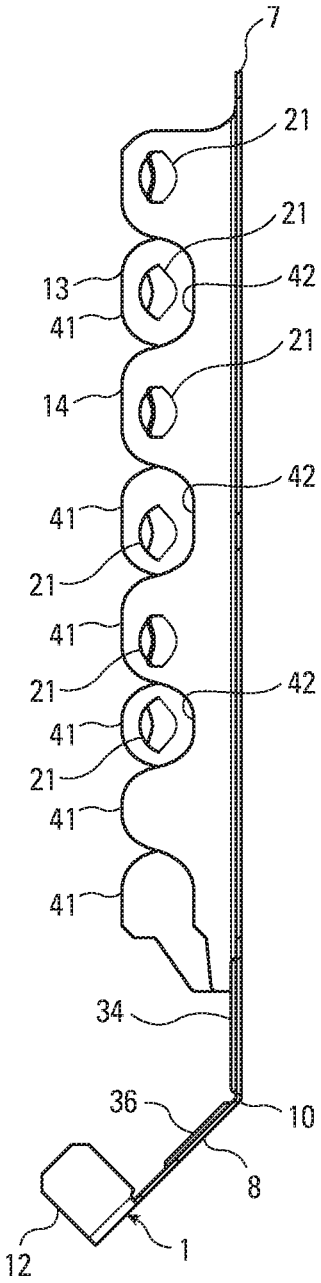
FIG. 9 is a left side view of the connector of the present invention.
Figure 10:
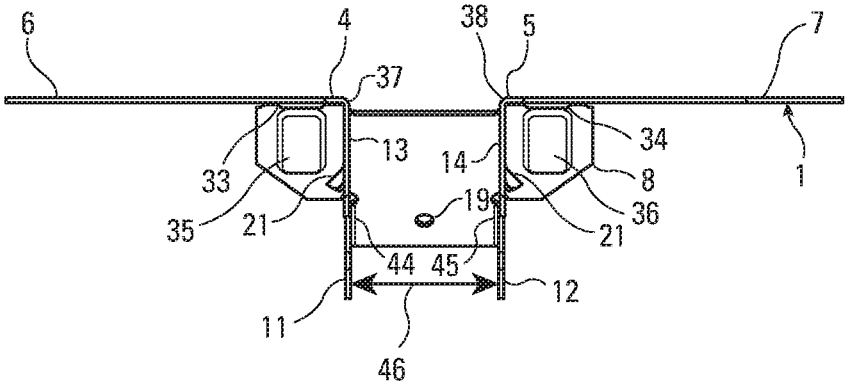
FIG. 10 is a top view of the connector of the present invention.
Figure 11:
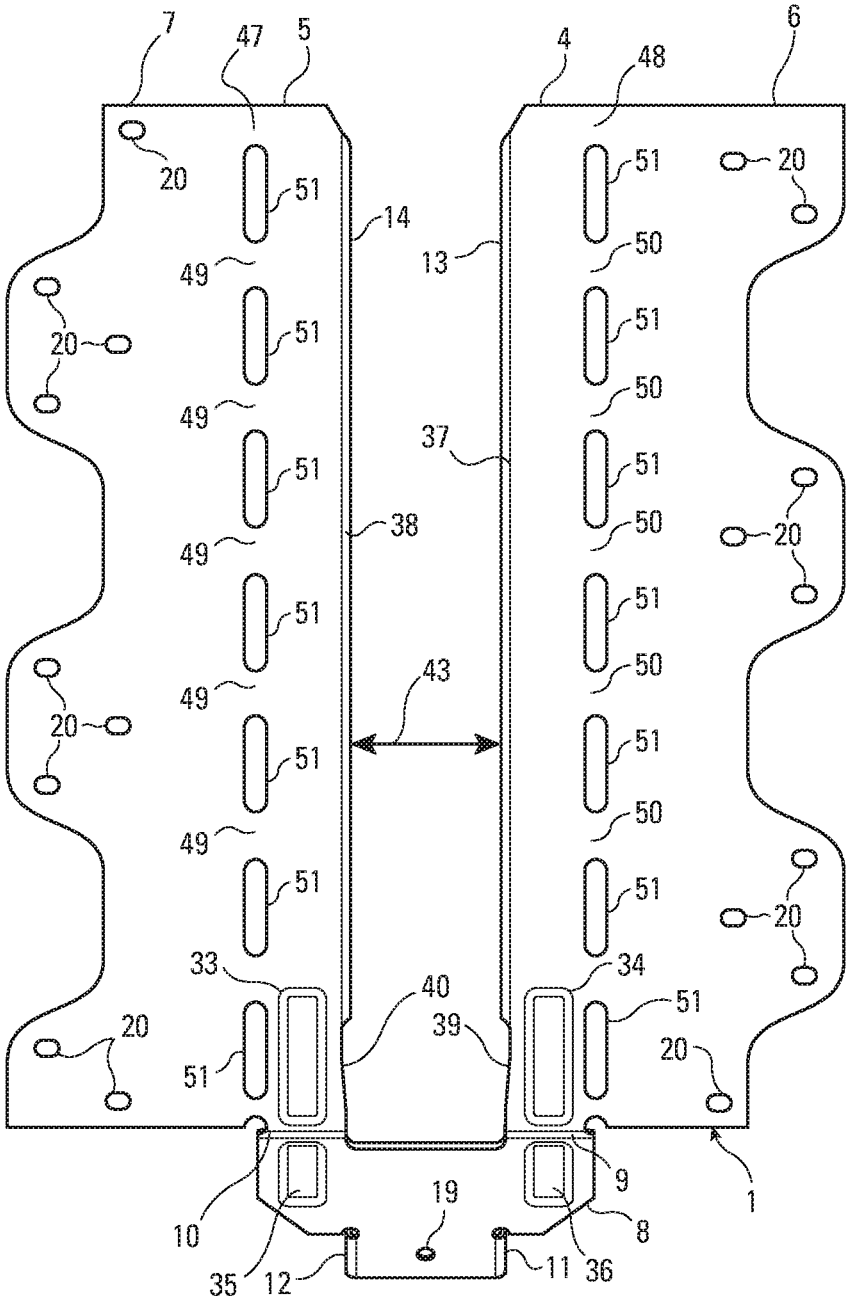
FIG. 11 is a back view of the connector of the present invention.
Figure 12:
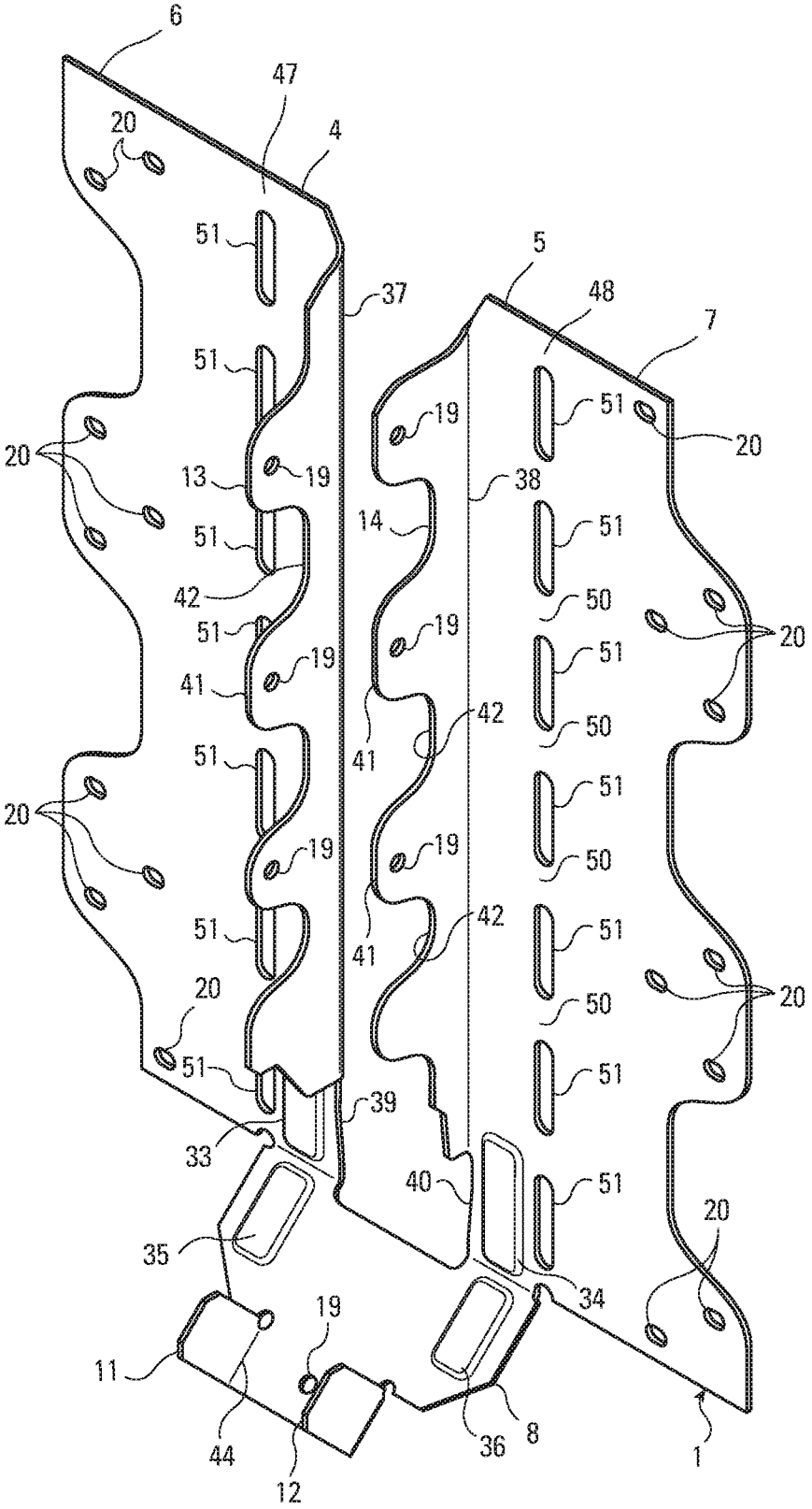
FIG. 12 is a perspective view of an alternate connector of the present invention.

As shown in FIGS. 3 and 7, the connector 1 is formed with left and right back members 4 and 5. The left and right back members 4 and 5 are substantially planar members that lie in the same plane. The back members 4 and 5 are spaced apart from each other a sufficient distance to accept the supported member 2 between them with little or no contact between the left and right sides 22 and 23 of the supported member 2 and the back members 4 and 5, and with no contact between the back members 4 and 5 and the end face 25 of the supported member 2. The left and right back members 4 and 5 are each connected to the seat member 8, and are only connected to each other through the seat member 8. The seat member 8 is sufficiently strong to hold the left and right back members 4 and 5 in their spaced relationship. As shown in FIG. 7, the left and right back members 4 and 5 are preferably formed with left and right embossments 33 and 34 near the left and right seat bend lines 9 and 10, respectively. These embossments 33 and 34 are preferably rectangular. Similarly, the seat member 8 is preferably formed with left and right embossments 35 and 36 near the left and right seat bends lines 9 and 10. The embossments 35 and 36 of the seat member 8 are preferably rectangular members that are aligned with the left and right embossments 33 and 34 of the left and right back members 4 and 5 respectively.

Figure 2:
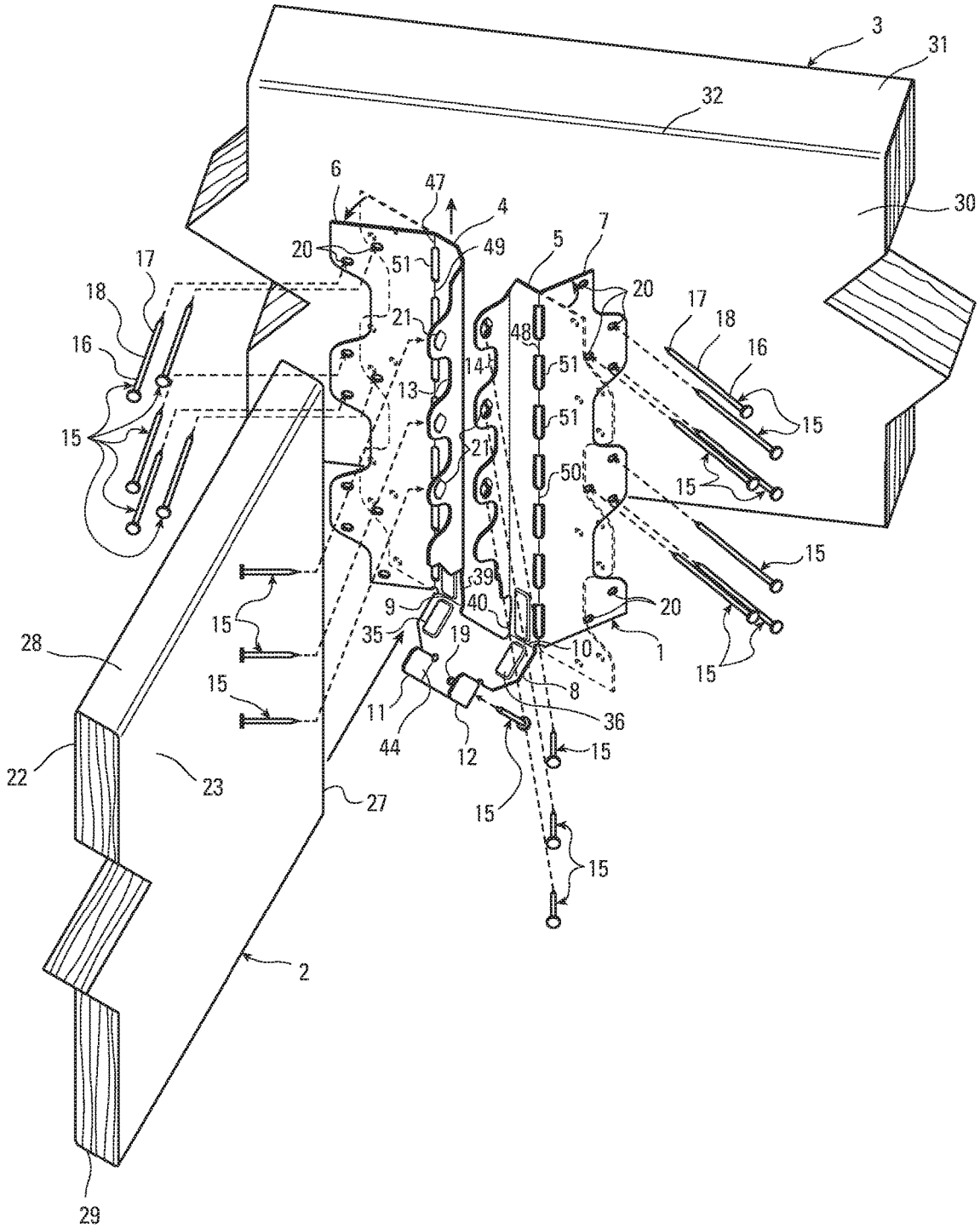
FIG. 2 is an exploded, perspective view of the connection of the present invention.

As shown in FIGS. 1, 2 and 4, the left and right jutting tabs 13 and 14 are spaced apart from each other a sufficient distance to accept the supported member 2 between them; however, the jutting tabs 13 and 14 are bent so that they align with and register with the left and right sides 6 and 7 of the supported member 2. The left and right jutting tabs 13 and 14 attach to the left and right back members 4 and 5 along left and right tab bend lines 37 and 38 on the inner side edges 39 and 40 of the left and right back members 4 and 5, respectively. The left and right jutting tabs 13 and 14 are preferably formed with corresponding projections 41 and notches 42 to better space the fasteners 15 that are driven through the jutting tabs 13 and 14. This also maximizes the material of the jutting tabs 13 and 14 when cut from a sheet steel blank as is the preferred method of forming the connector 1. The connector 1 is preferably made from thin sheet steel that is formed on automated machinery.

As shown in FIGS. 2, 3 and 7, the seat member 8 is an integral part of the back members 4 and 5 of the hanger 1. The seat member 8 is preferably connected to the back members 4 and 5 at the bottom of the back members 4 and 5. Preferably, the seat member 8 is a generally planar member. The seat member 8 is preferably connected to the back members 4 and 5 along aligned left and right seat bend lines 9 and 10. The seat member 8 is integrally connected to the back members 4 and 5 along the left and right seat bend lines 9 and 10. The seat member 8 extends angularly from the back members 4 and 5 a selected distance. The left and right back members 4 and 5 extend upwardly from the left and right seat bend lines 9 and 10, respectively. Above the left and right seat bend lines 9 and 10, the left and right back members 4 and 5 are spaced apart a second selected distance 43 that is greater than the first selected distance 24 between the left and right sides 6 and 7 of the supported member 2.

As shown in FIGS. 2 and 3, left and right seat side members 11 and 12 are preferably integrally connected to opposed sides of the seat member 8 at left and right seat side bend lines 44 and 45 and extend generally parallel to each other and angularly to the seat member 8. The seat side members 11 and 12 are spaced apart a third selected distance 46 that is also greater than the first selected distance 24 between the left and right sides 22 and 23 of the supported member 2. The seat side members 11 and 12 preferably interface closely with the left and right sides 22 and 23 of the supported member 2.

The seat member 8 may be set orthogonally from the back members 4 and 5, or the seat member 8 may slope upwardly or downwardly from 90 degrees. In some installations, the upward slope may be up to 49 degrees with very little loss in load capacity. In some installations, the hanger 1 can accommodate any upward slope to 45 degrees without a change in the allowable loads for the hanger. In some installations, between 45 degrees and 49 degrees, the allowable loads for the hanger 1 are slightly reduced. Similarly, in some installations, the downward slope may be as much as 49 degrees with only slight reduction in load capacity and with no difference in allowable loads up to slopes of 45 degrees downward.

As shown in FIG. 2, each back member 4 and 5 is formed with a jutting tab 13 and 14. The jutting tabs 13 and 14 extend generally parallel to each other and angularly to the back members 4 and 5 to which they are connected. The left and right jutting tabs 13 and 14 are preferably attached to left and right back inner side edges 39 and 40 of the left and right back members 4 and 5 respectively.

Openings 19, 20 and 21 for the fasteners 15 can take a variety of shapes and forms. Where fasteners 15 must be driven at an acute angle through the connector 1 into one or both of the supported member 2 and the supporting member 3 it is preferable to form the fastener opening with a fastener guide 21 or other opening that helps direct the fastener 15 at the proper acute angle.

U.S. Pat. No. 4,230,416, granted to Tyrell T. Gilb teaches a restricted slot nail opening 20. In a restricted slot nail opening 20, the opening is a slot-like opening having a length greater than its width. The width of the opening is selected to register with the sides of the fastener 15 that is driven through the opening. The extended length of the opening allows the fastener to be driven at a range of angles through the opening as compared to a circular opening that is close fitting with the shank of the fastener 15. In a closely formed circular opening the fastener 15 must be driven generally orthogonally to the face of the connector 1. As shown in FIG. 7, the side support members 6 and 7 are preferably formed with restricted slot fastener openings 20 as the side support members 6 and 7 can be bent at a variety of angles to the attachment face 30 of the supporting member 3 and thus the fasteners 15 can be driven at a variety of angles through the side support members 6 and 7.

U.S. Pat. No. 4,291,996, granted to Tyrell T. Gilb teaches a modified restricted slot nail opening that can guide a fastener 15 at a particular angle. Gilb called it a positive nail angling device. The positive nail angling device starts with a restricted slot nail opening. The width of the opening is selected to register with the sides of the fastener that is driven 15 through the opening. A tab-like member is formed from the displaced material from the slot-like opening and bent along a bend line which constitutes one end of the slit-like opening. The opening has an opposite end from the end from which the tab-like member is bent. The tab-like member is formed with a nail receiving surface for positively receiving a side of the fastener shank 16 in generally parallel, face to face relationship. The length of the slot-like opening and the displacement angle of the tab-like member are selected so that the fastener can only be driven at a pre-selected angle through the opening. One side of the shank 16 of the fastener 15 is in close fitting relation to the opposite end of the slot-like opening and the opposite side of the shank 16 of the fastener 15 is in touching or close fitting relation to the receiving surface of the tab-like member. If the tab is undisturbed, the fastener 15 can only be driven at a slant angle to the face of the connector 1.

U.S. Pat. No. 5,603,580, the specification of which is hereby incorporated by reference, granted to Leek and Commins teaches a fastener guide 21 or guideway somewhat similar to Gilb '996. The positive angle fastener device of Leek '580 taught forming a fastener guide 21 by making a slit cut in the material of the connector 1 and then bending the material at the slit cut to form a half-cone like shape for receiving and holding a fastener 15 at a selected angle while the fastener 15 is being driven. As shown in FIG. 3, a recent improvement to the Leek '580 guideway is to form the slit cut as an arc.

As shown in FIGS. 2, 3 and 7, left and right side support members 6 and 7 are attached to the opposed left and right outer side edges 47 and 48 of the left and right back members 4 and 5. At the outer side edge 47 and 48 of each back member 4 and 5, there is provided left and right longitudinally extending bend lines 49 and 50. The left and right longitudinally extending bend lines 49 and 50 separate each back member 4 and 5 from its adjacent left and right side support member 6 and 7. The left side support member 6 attaches to the left back member 4 along the left longitudinally extending bend line 49. The right side support member 7 attaches to the right back member 5 along the right longitudinally extending bend line 50. The left and right longitudinally extending bend lines 49 and 50 permit angular displacement of the side support members 6 and 7 for skewed attachment of the supported member 2 to the supporting member 3. As illustrated in FIGS. 2 and 4, the left side support member 6 is bent at a first angle, and the right side support member 7 is bent at a second angle. Bending of the side support members 6 and 7 with respect to the back members 4 and 5 is facilitated by the provision of slots 51 which are aligned with one another along the longitudinally extending bend lines 49 and 50 between the left and right back members 4 and 5 and the left and right side support members 6 and 7 respectively.

FIGS. 1, 2 and 4 illustrate the connector 1 skewed to the left, but a reversal of the direction or bending of the side support members 6 and 7 along the longitudinal bend lines 49 and 50 creates a rightwardly skewed connector.

The retrofit connection, when the supported member 2 is already attached to the supporting member 3, is formed by inserting the connector 1 of the present invention underneath the supported member 2. The supported member 2 is inserted between the jutting tabs 13 and 14 and the back members 4 and 5 of the present invention. The seat member 8 is then field bent to engage the bottom face 29 of the joist or supported member 2. If the connection is not skewed, the back members 4 and 5 are set to engage the attachment face 30 of the supporting member 3 and fasteners 15 are driven through the jutting tabs 13 and 14, the side support members 6 and 7 and the seat member 8 to make the connection. If the connection is skewed, the side support members 6 and 7 are field bent. The side support member 6 or 7 on the side of the connection where an acute angle is formed between the supported member 2 and the supporting member 3 is bent to interface and register in parallel relation with the attachment face 30 of the supporting member 3. On the opposite side, the side support member 26 or 7 is bent to contact the attachment face 30 of the supporting member 3. Fasteners 15 are then driven through the side support member members 6 and 7, the jutting tabs 13 and 14 and the seat member 8 to make the connection.

We claim:

1. A connection between a supported member and a supporting member, the connection comprising:

a. the supported member, the supported member having left and right sides that are generally parallel to each other and are spaced apart a first selected distance, the supported member also having an end face that meets with the left and right sides of the supported member at left and right side edges of the end face, the supported member also having a top face and a bottom face that meet with the left and right sides and the end face;

b. the supporting member, the supporting member having an attachment face with the end face of the supported member being in close proximity to the attachment face such that the end face of the supported member abuts with the attachment face of the supporting member, or one of the left and right side edges of the end face is in close proximity to the attachment face of the supporting member;

c. a connector, the connector having left and right generally planar back members connected by a generally planar seat member, the left and right back members generally lie in a single plane and are connected to each other only through the seat member, the seat member being attached to the left and right back members along aligned left and right seat bend lines, the left and right back members extend upwardly from the left and right seat bend lines, and above the left and right seat bend lines, the left and right back members are spaced apart a second selected distance that is greater than the first selected distance between the left and right sides of the supported member, and the left and right back members are disposed orthogonally to the left and right side members of the supported member, and the seat member interfaces with the bottom face of the supported member; the connector further having left and right side support members attached to the left and right back members respectively, the left and right side support members are generally planar members, the left side support member is non-parallel with the left back member, and the right side support member is non-parallel with the right back member, the left and right side support members contact the attachment face of the supporting member and are not in contact with the left and right sides of the supported member, fasteners are driven through the left side support member and into the supporting member, and fasteners are driven through the right side support member and into the supporting member; and d. fasteners attach the connector to the supported member.

2. The connection of claim 1, wherein:

left and right jutting tabs extend from the left and right back members respectively, the left and right jutting tabs interface with the left and right sides of the supported member.

3. The connection of claim 2, wherein:

a. the left jutting tab is attached to the left side of the supported member by one or more fasteners; and b. the right jutting tab is attached to the right side of the supported member by one or more fasteners.

4. The connection of claim 2, wherein:

the left and right jutting tabs that extend from the left and right back members are attached to the back members at inner side edges of the left and right back members.

5. The connection of claim 2, wherein:

the left and right jutting tabs are formed with one or more fastener guides such that the fasteners driven through the fastener guides in the left and right jutting tabs are driven at an angle such that the fasteners driven through the fastener guides in the jutting tabs first enter the supported member and then the supporting member.

6. The connection of claim 1, wherein:

left and right seat side members extend upwardly from the seat member and interface with the left and right sides of the supported member.

7. The connection of claim 1, wherein:

a. the left back member is formed with a left back embossment near the left seat bend line; and b. the right back member is formed with a right back embossment near the right seat bend line.

8. The connection of claim 7, wherein:

a. the seat member is formed with a left seat embossment near the left seat bend line; and b. the seat member is formed with a right seat embossment near the right seat bend line.

9. The connection of claim 7, wherein:

the left and right back embossments in the left and right back members are rectangular.

10. The connection of claim 8, wherein:

the left and right seat embossments in the seat member are rectangular.

11. The connection of claim 1, wherein:

a. the attachment face of the supporting member is generally vertically disposed;

b. the end face of the supported member is disposed generally vertically; and c. the bottom face of the supported member is disposed at an angle different from 90 degrees to the end face of the supported member.

12. The connection of claim 1, wherein:

a fastener is driven through the seat member and into the bottom face of the supported member.

13. The connection of claim 1, wherein:

the left and right side support members that extend from the left and right back members are attached to the back members at outer side edges of the left and right back members, the outer side edges being located away from the left and right side edges of the end face of the supported member.

14. The connection of claim 2, wherein:

a. the left side support member that is attached to the left back member extends from a side of the left back member opposed to a side of the back member to which the left jutting tab attaches; and b. the right side support member that is attached to the right back member extends from a side of the right back member opposed to a side of the back member to which the right jutting tab attaches.

* * * * *